US011624504B2

(12) United States Patent
Ha et al.

(10) Patent No.: US 11,624,504 B2
(45) Date of Patent: Apr. 11, 2023

(54) CONTROL METHOD OF GAS FURNACE

(71) Applicant: LG ELECTRONICS INC., Seoul (KR)

(72) Inventors: Doyong Ha, Seoul (KR); Yongki Jeong, Seoul (KR); Janghee Park, Seoul (KR); Jusu Kim, Seoul (KR); Hansaem Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 311 days.

(21) Appl. No.: 16/726,368

(22) Filed: Dec. 24, 2019

(65) Prior Publication Data

US 2020/0208839 A1 Jul. 2, 2020

(30) Foreign Application Priority Data

Dec. 26, 2018 (KR) ..... 10-2018-0169081

(51) Int. Cl.
*F23N 5/18* (2006.01)
*F24H 3/06* (2022.01)
(Continued)

(52) U.S. Cl.
CPC ..... *F23N 5/184* (2013.01); *F24H 3/065* (2013.01); *F24H 9/2085* (2013.01); *F23N 1/007* (2013.01); *F24H 9/0073* (2013.01); *F24H 9/1881* (2013.01)

(58) Field of Classification Search
CPC ..... F16K 37/0083; F16K 37/0091; F16K 37/0075
See application file for complete search history.

(56) References Cited

U.S. PATENT DOCUMENTS 4,348,169 A 9/1982 Swithenbank et al.
6,247,919 B1 * 6/2001 Welz, Jr. ..... F23N 5/184 137/554

(Continued)

FOREIGN PATENT DOCUMENTS

CN 108302537 7/2018

OTHER PUBLICATIONS

European Search Report dated May 27, 2020 issued in Application No. 19219774.7.

*Primary Examiner* — Jason Lau
(74) *Attorney, Agent, or Firm* — Ked & Associates, LLP

(57) ABSTRACT

A method of controlling a gas furnace comprising a gas valve for supplying a fuel gas to a manifold; a burner through which the fuel gas discharged from the manifold passes; an igniter for igniting a mixture of fuel gas passed through the burner and air; and an inducer for generating a flow in which a combustion gas generated by the burning of the mixture is discharged to an exhaust pipe via a heat exchanger, wherein the gas furnace performs a heating operation according to a heating signal or a heating stop according to a stop signal, includes the steps of: (a) receiving any one of the heating signal or the stop signal; (b) transmitting a signal to operate the inducer when the heating signal is received; (c) operating the igniter; (d) transmitting a signal to open the gas valve; (e) detecting whether the gas valve is opened or closed; (f) detecting a flow rate of the fuel gas in the manifold; and (g) displaying a normal operation of the heating operation, based on information detected in the steps (e) and (f).

15 Claims, 5 Drawing Sheets

(51) Int. Cl.

| | |
|---|---|
| ***F24H 9/20*** | (2022.01) |
| *F23N 1/00* | (2006.01) |
| *F24H 9/00* | (2022.01) |
| *F24H 9/1881* | (2022.01) |

(56) References Cited

U.S. PATENT DOCUMENTS

| | | | | |
|---|---|---|---|---|
| 6,257,870 | B1 | 7/2001 | Hugghins et al. | |
| 2005/0155535 | A1* | 7/2005 | Rieke | F23J 13/00 110/349 |
| 2016/0123588 | A1* | 5/2016 | Vie | F23N 5/242 431/18 |
| 2019/0032961 | A1* | 1/2019 | Murray | F24H 3/0488 |
| 2020/0072373 | A1* | 3/2020 | Noboa | G05B 6/02 |

* cited by examiner

CONTROL METHOD OF GAS FURNACE

CROSS REFERENCE TO RELATED APPLICATIONS

This application claims the priority benefit of Korean Patent Application No. 10-2018-0169081, filed on Dec. 26, 2018 in the Korean Intellectual Property Office, the disclosure of which is incorporated herein by reference.

BACKGROUND

1. Field of the Invention

The present disclosure relates to a control method for a gas furnace, and more particularly, to a control method of a gas furnace for detecting an abnormal operation of each of a gas valve and a flow sensor.

2. Description of the Related Art

Generally, a gas furnace is an apparatus that heats indoor air by supplying air, to a room, that exchanged heat with a flame and a high temperature combustion gas that are generated when the fuel gas is burned.

If the gas valve that controls the supply amount of the fuel gas is malfunctioning, the fuel gas may be supplied to a heat exchanger even during the heating stop, thereby causing an accident that the gas is exploded upon ignition for the heating operation.

The conventional control method of the gas furnace only discloses a method of controlling the opening or closing of the gas valve or the degree of opening, but is not able to provide a method of detecting the malfunction of the gas valve.

In addition, it is not able to provide a method of monitoring whether the flow rate of the fuel gas in a manifold corresponds to a signal for adjusting the degree of opening of the gas valve.

SUMMARY OF THE INVENTION

The present disclosure has been made in view of the above problems, and provides a control method of a gas furnace for detecting a malfunction of a gas valve.

The present disclosure further provides a control method of a gas furnace for continuously monitoring whether the degree of opening of a gas valve corresponds to a control signal.

In accordance with an aspect of the present disclosure, a method of controlling a gas furnace comprising a gas valve for supplying a fuel gas to a manifold; a burner through which the fuel gas discharged from the manifold passes; an igniter for igniting a mixture of fuel gas passed through the burner and air; and an inducer for generating a flow in which a combustion gas generated by the burning of the mixture is discharged to an exhaust pipe via a heat exchanger, wherein the gas furnace performs a heating operation according to a heating signal or a heating stop according to a stop signal, includes the steps of: (a) receiving any one of the heating signal or the stop signal; (b) transmitting a signal to operate the inducer when the heating signal is received; (c) operating the igniter; (d) transmitting a signal to open the gas valve; (e) detecting whether the gas valve is opened or closed; (f) detecting a flow rate of the fuel gas in the manifold; and (g) displaying a normal operation of the heating operation, based on information detected in the steps (e) and (f).

The step (f) includes detecting the flow rate of the fuel gas in the manifold by using a flow sensor provided in the manifold.

The step (g) includes displaying the normal operation of the heating operation, when it is detected that the gas valve is opened at step (e), and when it is detected that the flow rate of the fuel gas in the manifold exceeds '0' at step (f).

The step (g) includes displaying an abnormal operation of the flow sensor, when it is detected that the gas valve is opened at step (e), and when it is detected that the flow rate of the fuel gas in the manifold is '0' at step (f).

The step (g) includes displaying an abnormal operation of the gas valve, when it is detected that the gas valve is closed at step (e), and when it is detected that the flow rate of the fuel gas in the manifold exceeds '0' at step (f).

The step (g) includes displaying an abnormal operation of the gas valve and the flow sensor, when it is detected that the gas valve is closed at step (e), and when it is detected that the flow rate of the fuel gas in the manifold is '0' at step (f).

The method further includes a step (h) of stopping the heating operation by stopping the operation of the igniter, closing the gas valve, and maintaining the operation of the inducer, when at least one of the gas valve and the flow sensor is abnormal.

The operation stop of the igniter at step (h) is able to be released only when a check of the gas valve and the flow sensor is completed, if at least one of the gas valve and the flow sensor is abnormal.

The step (d) includes transmitting a signal so that the gas valve is opened stepwise in correspondence with a certain required thermal power of the gas furnace, and further comprises a step of monitoring whether the flow rate of the fuel gas in the manifold detected at step (f) corresponds to the signal transmitted at step (d).

After the step (a), the method further includes the steps of: (i) stopping the operation of the igniter, when the stop signal is received; (j) transmitting a signal to close the gas valve; (k) detecting whether the gas valve is opened or closed; (1) detecting a flow rate of the fuel gas in the manifold; and (m) displaying a normal operation of the heating stop, based on information detected at steps (k) and (l).

BRIEF DESCRIPTION OF THE DRAWINGS

The above and other objects, features and advantages of the present disclosure will be more apparent from the following detailed description in conjunction with the accompanying drawings, in which.

DETAILED DESCRIPTION

Exemplary embodiments of the present disclosure are described with reference to the accompanying drawings in detail. The same reference numbers are used throughout the drawings to refer to the same or like parts. Detailed descriptions of well-known functions and structures incorporated herein may be omitted to avoid obscuring the subject matter of the present disclosure.

Hereinafter, a gas furnace according to an embodiment of the present disclosure will be described with reference to FIGS. 1 and 2.

Figure 1:
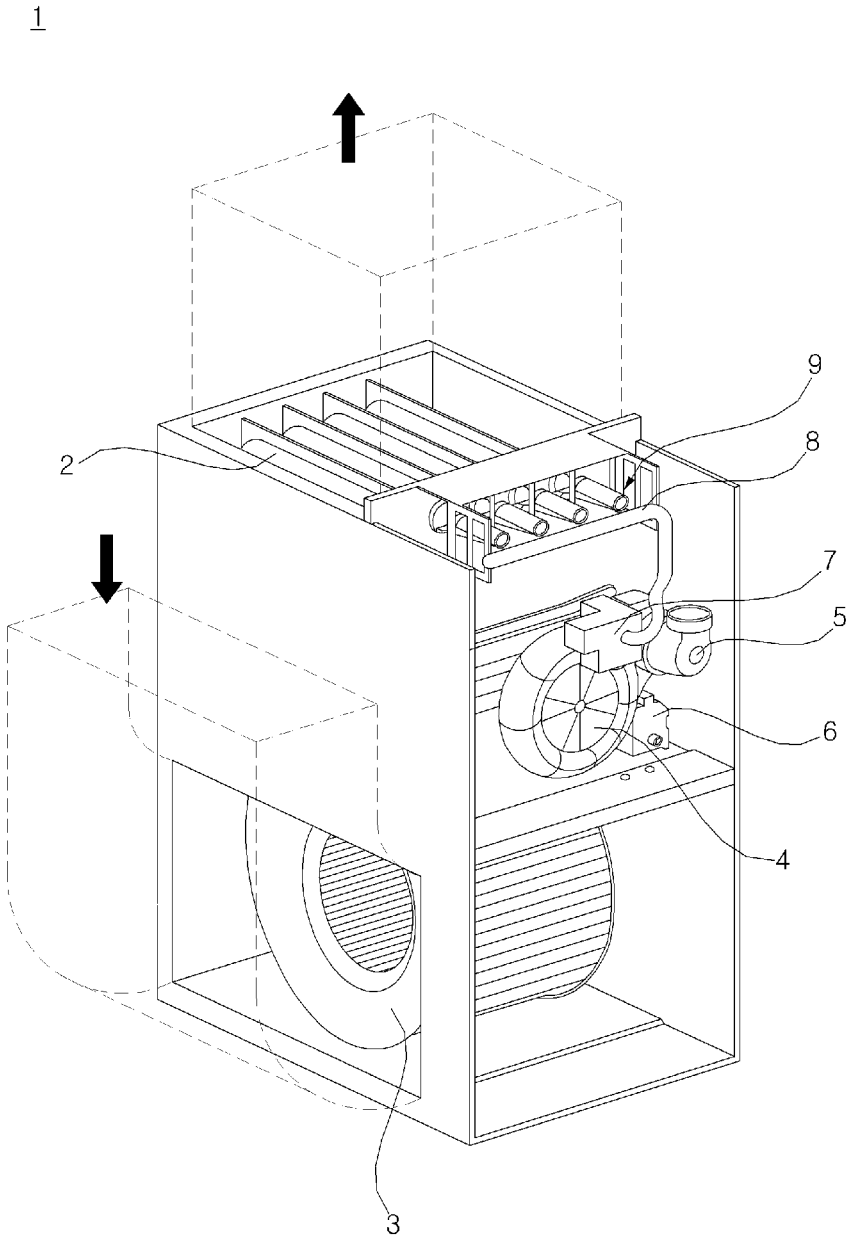
FIG. 1 is a perspective view of a gas furnace according to an embodiment of the present disclosure.
Figure 2:
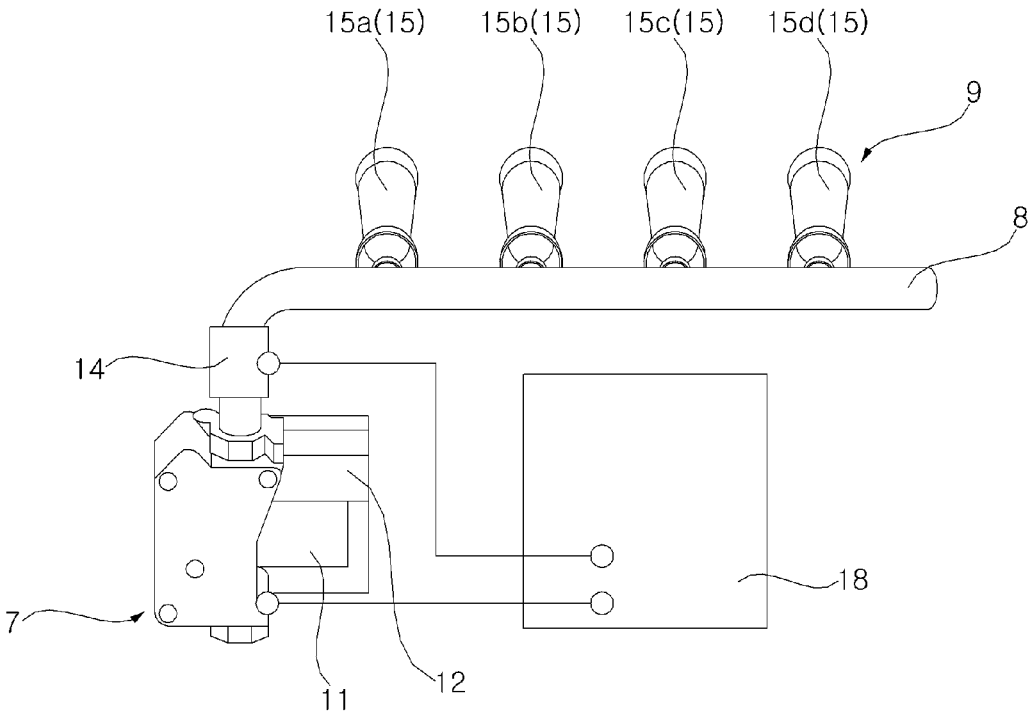
FIG. 2 is a diagram illustrating a part of a configuration of the gas furnace of FIG. 1.

FIG. 1 is a perspective view of a gas furnace according to an embodiment of the present disclosure, and FIG. 2 is a diagram illustrating a part of a configuration of the gas furnace of FIG. 1.

The gas furnace 1 is an apparatus that heats indoor air by supplying air, to a room, that exchanged heat with a flame and a high temperature combustion gas that are generated when the fuel gas is burned.

As shown in FIG. 1, the gas furnace 1 includes a gas valve 7 for supplying a fuel gas R to a manifold 8, a burner 9 through which the fuel gas R discharged from the manifold 8 passes, an igniter 16 for igniting a mixture of the fuel gas R that passed through the burner 9 and the air, and an inducer 4 for generating a flow in which the combustion gas P generated by burning the mixture is discharged to an exhaust pipe 5 via a heat exchanger 2.

A liquefied natural gas (LNG) obtained by cooling and liquefying natural gas or a liquefied petroleum gas (LPG) obtained by pressurizing and liquefying a gas obtained as a byproduct of a petroleum refining process may be used as the fuel gas R supplied through the gas valve 7.

The fuel gas R may be blocked or supplied to the manifold 8 by opening and closing the gas valve 7, and the amount of the fuel gas R supplied to the manifold 8 may be adjusted by adjusting the degree of opening of the gas valve 7. Thus, the gas valve 7 may adjust the thermal power of the gas furnace 1.

The manifold 8 may be connected to the gas valve 7 via a gas pipe (not shown). At least one discharge port for discharging the fuel gas R may be formed in the manifold 8.

The fuel gas R supplied to the manifold 8 may be introduced into the nozzle through the discharge port. The nozzle may inject the fuel gas R toward the burner 9 described later.

As shown in FIGS. 1 and 2, the fuel gas R discharged from the manifold 8 may be introduced into the burner 9. More precisely, the fuel gas R may be introduced into a venturi tube 15 of the burner 9. The fuel gas R may pass through the venturi tube 15 and may be mixed with air to form a mixture.

The mixture that passed through the burner 9 or the venturi tube 15 may be burned due to spark ignition of the igniter 16 (not shown) provided above the venturi tube 15. In this case, the mixture may be burned to generate a flame and a high-temperature combustion gas P.

The room may be heated by passing the air supplied to the room around the heat exchanger 2 through which the flame and the combustion gas P pass.

The heat exchanger 2 may be constituted by a first heat exchanger and a second heat exchanger.

One end of the first heat exchanger may be disposed adjacent to the burner 9. The other end opposite to one end of the first heat exchanger may be coupled to a coupling box (not shown). The combustion gas P passing from one end of the first heat exchanger to the other end may be transferred to the second heat exchanger through the coupling box.

One end of the second heat exchanger may be connected to the coupling box. The combustion gas P passed through the first heat exchanger may flow into one end of the second heat exchanger and pass through the second heat exchanger.

The second heat exchanger may perform heat exchange once again between the combustion gas P passed through the first heat exchanger and the air passing around the second heat exchanger.

That is, the efficiency of the gas furnace 1 may be improved by further utilizing the thermal energy of the combustion gas P that passed through the first second heat exchanger through the second heat exchanger.

The combustion gas P passing through the second heat exchanger is condensed through a process of heat transfer with the air passing around the second heat exchanger to generate condensed water. In other words, the water vapor contained in the combustion gas P may be condensed and may change state into condensed water.

For this reason, the gas furnace 1 having the first heat exchanger and the second heat exchanger may be referred to as a condensing gas furnace.

The condensed water generated at this time may be collected in a condensed water collecting part (not shown). To this end, the other end opposite to one end of the second heat exchanger may be connected to one side surface of the condensed water collecting part.

An inducer 4 described later may be coupled to the other side surface of the condensed water collecting part. Hereinafter, for the sake of simplicity, it is described that the inducer 4 is coupled to the condensed water collecting part, but the inducer 4 may be coupled to a mounting plate to which the condensed water collecting part is coupled.

An opening may be formed in the condensed water collecting part. The other end of the second heat exchanger and the inducer 4 may communicate with each other through the opening formed in the condensed water collecting part.

That is, the combustion gas P that passed through the other end of the second heat exchanger may escape to the inducer 4 through the opening formed in the condensed water collecting part, and then may be discharged to the outside of the gas furnace 1 via the exhaust pipe 5.

The condensed water generated in the second heat exchanger may be discharged to the outside of the gas furnace 1 through an outlet port, after escaping to the condensed water trap 6 through the condensed water collecting part.

At this time, the condensed water trap 6 may be coupled to the other side surface of the condensed water collecting part. The condensed water trap 6 may collect not only the condensed water generated in the second heat exchanger bur also the condensed water generated in the exhaust pipe 5 connected to the inducer 4, and discharge the collected condensed water.

That is, the condensed water that is generated when the combustion gas P which is not condensed yet in the other end of the second heat exchanger is condensed through the exhaust pipe 5 is also collected by the condensed water trap 6, and may be discharged to the outside of the gas furnace 1.

The inducer 4 may communicate with the other end of the second heat exchanger by the medium of the opening formed in the condensed water collecting part.

One end of the inducer 4 is coupled to the other side of the condensed water collecting part and the other end of the inducer 4 may be coupled to the exhaust pipe 5.

The inducer 4 may induce a flow stream that the combustion gas P passes through the first heat exchanger, the coupling box, and the second heat exchanger and is discharged to the exhaust pipe 5. In this regard, the inducer 4 may be understood as an Induced Draft Motor (IDM).

The blower 3 for gas furnace may be positioned below the gas furnace 1. The air supplied to the room may be moved from the lower portion of the gas furnace 1 to the upper portion by the blower 3. In this regard, the blower 3 may be understood as Indoor Blower Motor (IBM).

The blower 3 may allow air to pass around the heat exchanger 2.

The air passing around the heat exchanger 2 by the blower 3 may receive the thermal energy from the high temperature combustion gas P by the medium of the heat exchanger 2 so that the temperature can be raised. The air having raised temperature may be supplied to the room, so that the room can be heated.

The gas furnace 1 may include a case (not shown). The configurations of the gas furnace 1 described above may be accommodated inside the case. A lower opening (not shown) may be formed in a lower portion of the case adjacent to the blower 3. Air passing around the heat exchanger 2 through the lower opening may be introduced into the case.

An opening (not shown) for exhaust pipe through which the exhaust pipe 5 passes may be formed in the upper portion of the case, but the position is not limited thereto.

In the upper portion of the case, an upper opening (not shown) may be formed in a side surface adjacent to the upper side of the heat exchanger 2. The air that passed around the heat exchanger 2 through the upper opening and has a risen temperature may be discharged to the outside of the case and supplied to the room.

The lower opening and the upper opening may be provided with a duct (not shown) for communicating the indoor space which is a heating target space with the gas furnace 1.

A filter (not shown) may be installed between the lower opening and the duct installed therein so as to filter foreign substances such as dust existing in the air.

As described above, since the second heat exchanger is configured to additionally use the thermal energy of the combustion gas P that passed through the first heat exchanger, it may be easily understood that the efficiency of the gas furnace using the first and second heat exchangers is better than that of the gas furnace using only the first heat exchanger.

The control method of the gas furnace according to the embodiment of the present disclosure may be applied not only to the gas furnace to which only the first heat exchanger is applied, but also to the gas furnaces to which the first heat exchanger and the second heat exchanger are applied.

As described above, depending on the opening or closing of the gas valve 7 or the degree of opening of the gas valve 7, the amount of the fuel gas R supplied to the manifold 8 or the venturi tube 15 is determined. Therefore, if the gas valve 7 malfunctions without following a control signal such as a heating operation signal or a thermal power control signal of the gas furnace 1, the degree of heating desired by a user is not achieved or the unburned fuel gas R is accumulated in the heat exchanger 2. Thus, there may occur a risk of gas explosion.

Therefore, it is necessary to detect the malfunction of the gas valve 7, to inform the user of the malfunction so as to take proper safety measures, and to operate the system conditionally until the safety is secured. The present disclosure has been made to solve the above problems.

Hereinafter, the method of controlling a gas furnace according to an embodiment of the present disclosure will be described in detail with reference to FIGS. 1 to 5.

Figure 3:
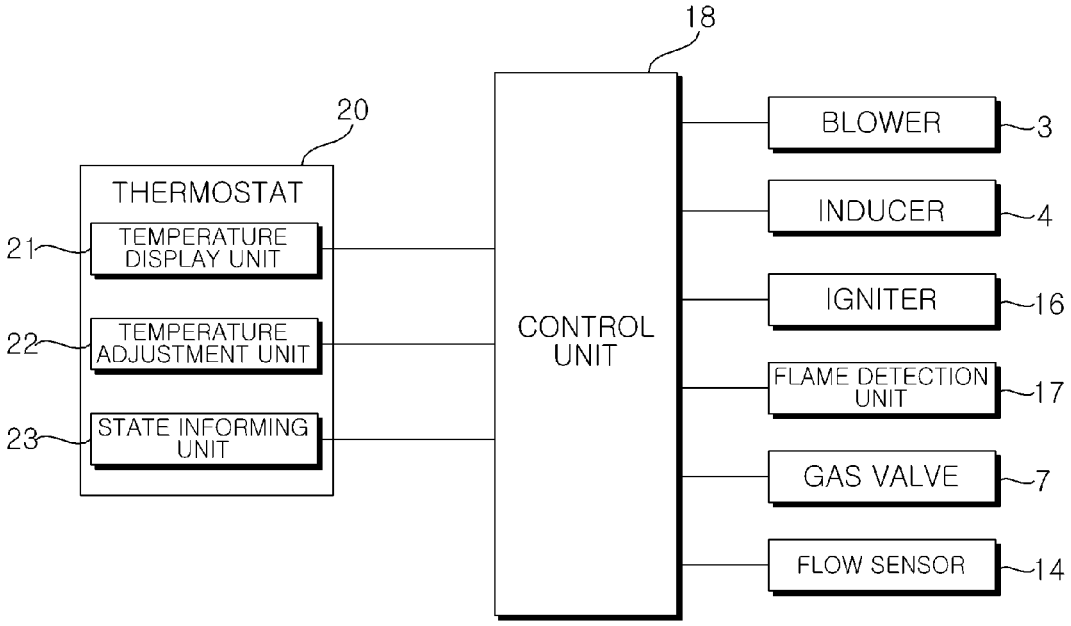
FIG. 3 is a control block diagram of a gas furnace according to an embodiment of the present disclosure.
Figure 4:
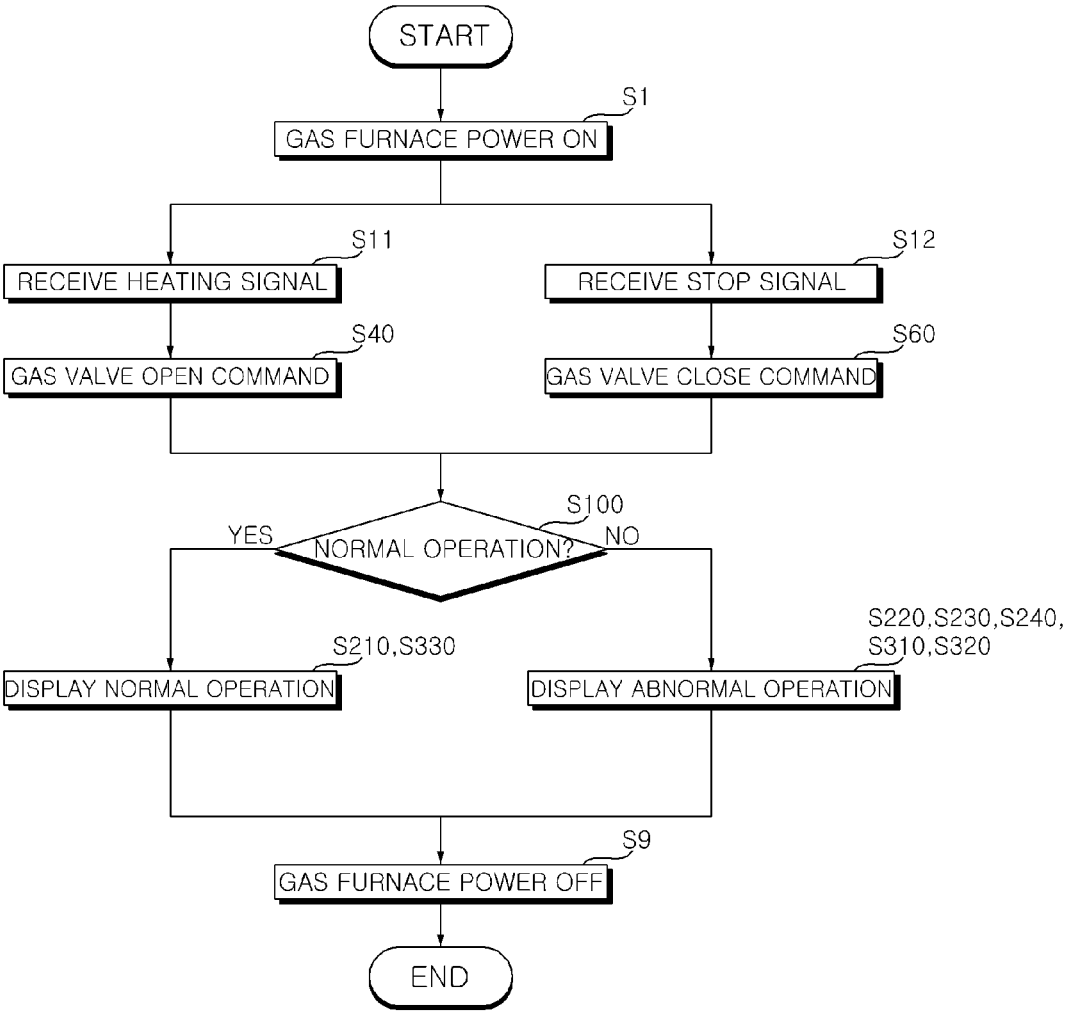
FIG. 4 is a flow chart schematically illustrating a control method of a gas furnace according to an embodiment of the present disclosure.
Figure 5:
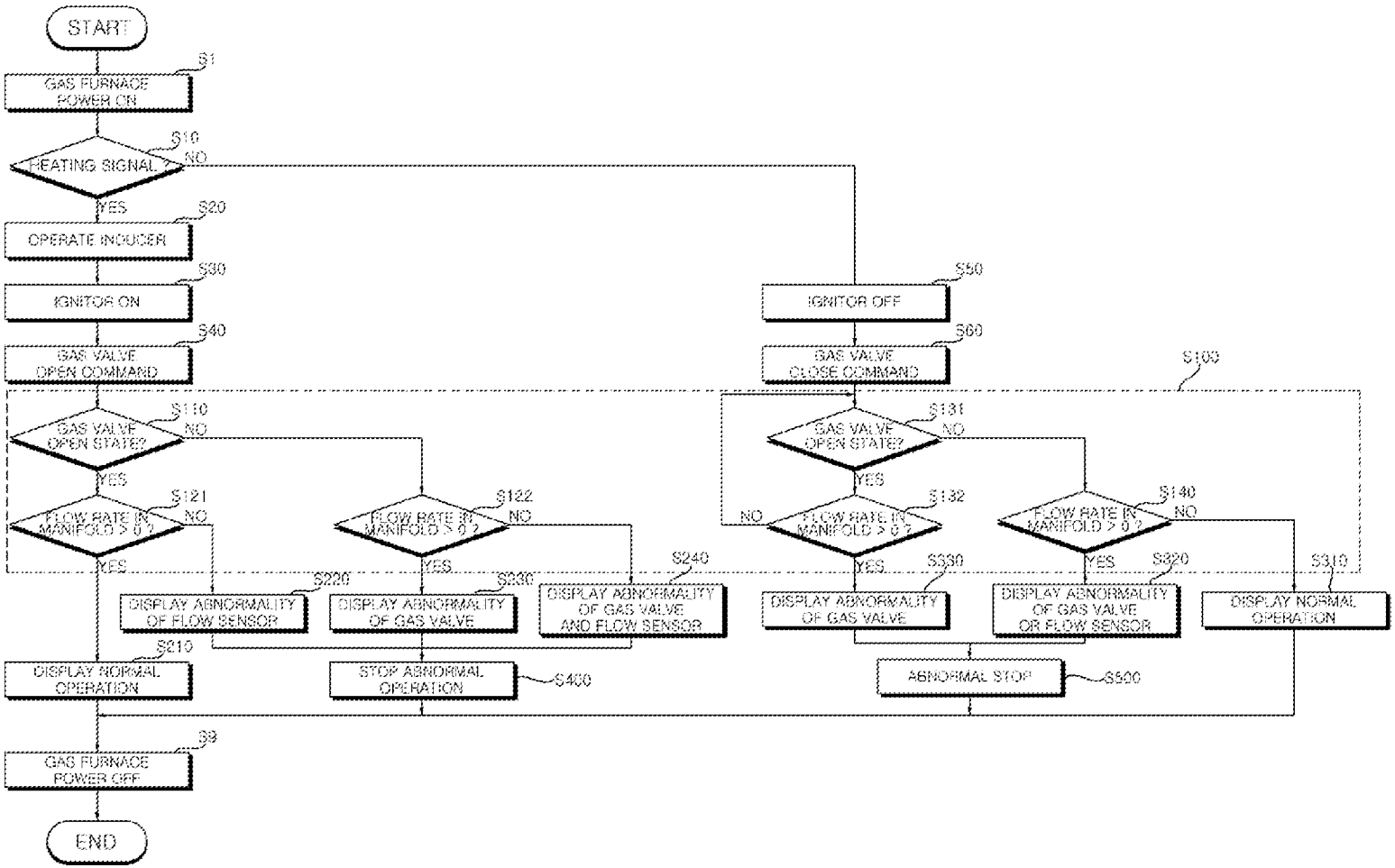
FIG. 5 is a flow chart illustrating a method of controlling a gas furnace in detail according to an embodiment of the present disclosure.

FIG. 3 is a control block diagram of a gas furnace according to an embodiment of the present disclosure, FIG. 4 is a flow chart schematically illustrating a control method of a gas furnace according to an embodiment of the present disclosure, and FIG. 5 is a flow chart illustrating a method of controlling a gas furnace in detail according to an embodiment of the present disclosure.

As shown in FIG. 3, each of the steps constituting the control method of the gas furnace according to the embodiment of the present described later may be performed through the controller 18 provided in the gas furnace 1.

The controller 18 may be implemented by using at least one of an application specific integrated circuit (ASIC), digital signal processors (DSPs), digital signal processing devices (DSPDs), programmable logic devices (PLDs), field programmable gate arrays (FPGAs), processors, controllers, micro-controllers, microprocessors, and other electronic units for performing other functions.

The control method of the gas furnace according to the embodiment of the present disclosure described later may be performed, after a step S1 of turning on the power supply of the gas furnace 1 is executed, before a step S9 of turning off the power supply of the gas furnace 1 is executed.

The gas furnace 1 may be in operation or not be in operation while the gas furnace 1 is turned on.

Here, the fact that the gas furnace 1 is in operation means a case where the fuel gas R flows into the manifold 8 and the venturi tube 15 as the gas valve 7 is opened, and the flame and the combustion gas P of high temperature generated by the combustion of the introduced fuel gas R pass through the interior of the heat exchanger 2.

On the other hand, the fact that the gas furnace 1 is not in operation means a case where the gas valve 8 is closed to block the inflow of the fuel gas R into the manifold 8 and the venturi tube 15.

The present disclosure relates to the control method of a gas furnace that performs heating operation in response to a heating signal R1 or stops heating in response to a stop signal R2. Here, the heating signal R1 is a signal for instructing the gas furnace 1 to enter the operating state, and the stop signal R2 is a signal for instructing the gas furnace 1 to enter the non-operating state.

As shown in FIGS. 4 and 5, the control method of a gas furnace according to an embodiment of the present disclosure includes a signal reception step S10, a gas valve open/close command step S40, S60, a normal operation detection step S100, and a normal operation display step.

The signal reception step S10 is a step of receiving one of the heating signal R1 or the stop signal R2. The signal reception step S10 may include a step S11 of receiving the heating signal R1 and a step S12 of receiving the stop signal R2.

The heating signal R1 and the stop signal R2 may be a signal transmitted to the gas furnace 1 from a thermostat 20 provided in a room which is a heating target space. The thermostat 20 may include a thermocouple for measuring the room temperature Tr. The thermostat 20 may include a temperature display unit 21 for displaying a room temperature Tr and a set heating temperature Th to the occupant, a temperature adjustment unit 22 for allowing the occupant to adjust the set heating temperature Th, and a state informing unit 23 described later.

It is necessary to adjust the heating power of the gas furnace 1 according to the difference between the room temperature Tr and the set heating temperature Th so that the heating signal R1 can be subdivided into a weak heating signal and a strong heating signal. In this case, the degree of opening of the gas valve 7 is determined in response to the heating intensity of the heating signal R1, so that the thermal power of the gas furnace 1 can be adjusted.

In this case, if the difference between the room temperature Tr and the set heating temperature Th is less than a certain value, the thermostat 20 may transmit the weak heating signal W1 to the gas furnace 1. If the difference between the room temperature Tr and the set heating temperature Th is equal to or greater than the certain value, the thermostat 20 may transmit the strong heating signal W2 to the gas furnace 1.

Meanwhile, in the embodiment of the present disclosure, the thermostat 20 compares the room temperature Tr with the set heating temperature Th to transmit one of the weak heating signal W1 and the strong heating signal W2 to the gas furnace 1. However, the present disclosure is not limited thereto, and the occupant may directly transmit one of the weak heating signal W1 and the strong heating signal W2 to the gas furnace 1 through a manual input.

<Case of Receiving the Heating Signal R1>

When the heating signal R1 is received at step S11, a step S20 of transmitting a signal for operating the inducer 4 may be performed.

Prior to the ignition of the igniter 16 and the opening operation of the gas valve 7 described later, operating first the inducer 4 at step S20 is to minimize the safety risk such as gas explosion by discharging the gas, foreign matter, and the like remaining in the inside of the heat exchanger 2 according to the previous operation of the gas furnace 1 through the exhaust pipe 5.

After step S20, a step S30 of operating the igniter 16 may be performed. Here, the operation of the igniter 16 refers to the generation of spark ignition for combustion of the mixture that passed through the venturi tube 15.

At this time, when the mixture is burned due to ignition according to the operation of the igniter 16, a flame and a combustion gas P are generated, and it is possible to recognize whether the combustion reaction described above is properly performed by detecting the flame through a flame detection unit 17 installed in the upper side of the venturi tube 15.

Since a general technique may be applied to the means for detecting the flame in the flame detection unit 17, detailed description thereof will be omitted herein.

Meanwhile, the present disclosure focuses on securing the safety of the gas furnace 1 through the abnormal check of the gas valve 7 and a flow sensor 14, so that the malfunction of the igniter 16 is not a particular problem in the present disclosure.

That is, in the above-described or later steps that are performed as the heating signal R1 or the stop signal R2 is received, the igniter 16 is considered to be normally operated or stopped. Furthermore, it is premised that the flame is detected in the flame detection unit 17 in the heating signal R1 and premised that the flame is not detected in the flame detection unit 17 in the stop signal R2.

Simply, it is obvious that the present disclosure can also be applied to the invention of detecting the malfunction of the igniter 16 and notifying the occupant of the malfunction, and it should be noted that the malfunction of the igniter 16 may be ignored so as to clarify the idea of the present disclosure.

After step S30, a gas valve open command step S40 may be performed. The gas valve open command step S40 is a step of transmitting a signal to open the gas valve 7. The signal transmitted at step S40 may include the above weak heating and strong heating signals, and may be a signal for adjusting the thermal power of the gas furnace 1 in a stepwise manner in detail according to the control design.

First, a method of detecting malfunction of the gas valve 7 in response to a signal transmitted at step S40 and displaying an operation abnormality to the outside is explained. Then, a method for monitoring whether the degree of opening of the gas valve 7 corresponds to the signal transmitted at step S40 is explained.

After step S40, a normal operation detection step S100 may be performed. More specifically, after step S40, a step S110 of detecting whether the gas valve 7 is opened or closed and a step S120 of detecting the flow rate of the fuel gas R in the manifold 8 may be performed.

In the embodiment of the present disclosure, a step S120 is performed after step S110, but it may be performed simultaneously or in reverse order.

A step S110 may be a step of detecting whether the gas valve 7 is opened or closed through a certain pressure and flow sensor. Since a general sensor for detecting the opening and closing of the valve can be applied to the sensor, detailed description thereof will be omitted herein.

As shown in FIG. 2, the gas valve 7 according to the embodiment of the present disclosure may include a solenoid valve 11 and a step motor 12.

The solenoid valve 11 is a valve that uses a principle that a plunger located inside the solenoid coil moves in the direction of a magnetic field when a certain current flows through the solenoid coil to form the magnetic field, and that can open or close a pipe channel.

The gas valve 7 combining the solenoid valve 11 and the step motor 12 can be understood as a linear valve for opening or closing the channel as well as adjusting the degree of opening of the pipe channel, and may adjust the thermal power of the gas furnace 1 stepwise.

A step S120 of detecting the flow rate of the fuel gas R in the manifold 8 may be a step of detecting the flow rate of the fuel gas R in the manifold 8 through the flow sensor 14, and the flow sensor 14 may be installed in the manifold 8.

The step S120 may include a step S121 of detecting the flow rate of the fuel gas R in the manifold 8 when the gas valve 7 is detected to be opened at step S110, and a step S122 of detecting the flow rate of the fuel gas R in the manifold 8 when the gas valve 7 is detected to be closed at step S110, That is, the present disclosure is characterized in that it is possible to detect malfunction of the gas valve 7 through the flow sensor 14 provided in the manifold 8 in addition to means for detecting whether the gas valve 7 is open or closed, thereby further improving the safety of the gas furnace 1.

After the normal operation detection step S100, a normal operation display step S200 may be performed. The normal operation display step S200 may be a step of displaying whether the heating operation is normally operated based on the information detected at step S100, and more specifically, is described in detail as follows.

The normal operation display step S200 may include a step S210 of displaying the normal operation of the heating operation, when it is detected that the gas valve 7 is opened at step S110, and when it is detected that the flow rate of the fuel gas R in the manifold 8 exceeds '0' at step S121.

The normal operation display step S200 may include a step S220 of displaying the abnormality of the flow sensor 14 when it is detected that the gas valve 7 is opened at step S110, and when it is detected that the flow rate of the fuel gas R in the manifold 8 is '0' at step S121.

The normal operation display step S200 may include a step S230 of displaying the abnormality of the gas valve 7 when it is detected that the gas valve 7 is closed at step S110, and when it is detected that the flow rate of the fuel gas R in the manifold 8 exceeds '0' at step S122.

The normal operation display step S200 may include a step S240 of displaying the abnormality of the gas valve 7 and the flow sensor 14 when it is detected that the gas valve 7 is closed at step S110, and when it is detected that the flow rate of the fuel gas R in the manifold 8 is '0' at step S122.

After steps S220, S230, and S240, an abnormal operation stop step S400 may be performed. The abnormal operation stop step S400 is a step of stopping the heating operation when at least one of the gas valve 7 and the flow sensor 14 is abnormal.

The step S400 may be a step of stopping the operation of the igniter 16, and allowing the gas valve 7 to be closed while maintaining the operation of the inducer 4.

That is, the step S400 may be a step of closing the gas valve 7 to block the supply of the fuel gas R, stopping the operation of the igniter 16 to stop the combustion of the fuel gas R, and continuously operating the inducer 4 to discharge the gas remaining in the heat exchanger 2 to the outside through the exhaust pipe 5. This makes it possible to eliminate safety hazards such as gas explosion due to abnormal operation of the gas valve 7 and the flow sensor 14.

In this case, the operation stop of the igniter 16 can be released only after the check of the gas valve 7 and the flow sensor 14 is completed. That is, after the operation of the igniter 16 is stopped as at least one of the gas valve 7 and the flow sensor 14 is abnormal, before the above check is accomplished, the igniter 16 may not be operated even if the heating signal R1 is received. This is to prevent the gas furnace 1 from being operated again before the safety of the gas furnace 1 is secured.

In the embodiment of the present disclosure, step S400 is performed after steps S220, S230, and S240, respectively, but may be performed simultaneously or in reverse order.

Meanwhile, the step S40 may be a step of transmitting a signal so that the gas valve 7 is opened stepwise according to a certain required thermal power of the gas furnace 1, and the degree of opening of the gas valve 7 may be adjusted in response to the signal.

In this case, a step S600 of monitoring whether the flow rate of the fuel gas R in the manifold 8 detected at step S121 corresponds to the signal transmitted at step S40 may be further included.

That is, whether the degree of opening of the gas valve 7 actually corresponds to the signal transmitted at the step S40 may be confirmed through the flow rate of the fuel gas R detected at step S121, and it is possible to notify the case where the degree of opening of the gas valve 7 and the signal correspond to each other (i.e., normal operation) or they do not correspond to each other (i.e., abnormal operation) to the occupant through the state informing unit 23 of the thermostat.

<Case of Receiving the Stop Signal R2>

If the stop signal R2 is received at step S12, step S50 of stopping the operation of the igniter 16 may be performed. Here, the stop of the operation of the igniter 16 means that the spark ignition by the igniter 16 described above is not generated.

At this time, by detecting that no flame is generated through the flame detection unit 17, it can be seen that the combustion reaction is not performed.

After step S50, the gas valve close command step S60 may be performed. The gas valve close command step S60 is a step of transmitting a signal to close the gas valve 7.

After step S60, the normal operation detection step S100 may be performed. More specifically, after step S60, a step S130 of detecting whether the gas valve 7 is opened or closed and a step S140 of detecting the flow rate of the fuel gas R in the manifold 8 may be performed.

In the embodiment of the present disclosure, step S140 is performed after step S130, but it may be performed simultaneously or in reverse order.

Step S130 may be a step of detecting whether the gas valve 7 is opened or closed through a certain pressure and flow sensor. Since a general sensor capable of detecting the opening and closing of the valve can be applied to the sensor, detailed description thereof will be omitted herein.

The step S130 may be a step (S131, S132) of detecting that the gas valve 7 is opened if the open state of the gas valve 7 is continued for a certain time.

As an example, when the certain time is 10 seconds, if the duration t of the gas valve 7 in the open state is 8 seconds and then if it is a close state, "the gas valve 7 is detected to be closed", and if the duration t of the gas valve 7 in the open state exceeds 10 seconds, "the gas valve 7 is detected to be opened".

It can be understood that the reason why the open state of the gas valve 7 is determined based on the certain time at step S130 is that the time required for actually closing the gas valve 7 in response to the signal transmitted at step S60 is considered.

The step S140 of detecting the flow rate of the fuel gas R in the manifold 8 may be a step of detecting the flow rate of the fuel gas R in the manifold 8 through the flow sensor 14, and the flow sensor 14 may be installed in the manifold 8.

That is, the present disclosure is characterized in that it is possible to detect malfunction of the gas valve 7 through the flow sensor 14 provided in the manifold 8 in addition to means for detecting whether the gas valve 7 is opened or closed. Thus, even when the heating is stopped, the fuel gas R is supplied into the heat exchanger 2 to prevent the occurrence of gas explosion at the time of the ignition for the heating operation.

Meanwhile, as shown in FIG. 5, in the embodiment of the present disclosure, step S140 is performed only when it is detected that the gas valve 7 is closed at step S130. Alternatively, the step of detecting the flow rate of the fuel gas R in the manifold 8 may be performed even when it is detected that the gas valve 7 is opened at step S130.

After the normal operation detection step S100, the normal operation display step S300 may be performed. The normal operation display step S300 may be a step of displaying whether the heating stop is normally performed based on information detected at step S100, and more specifically, is described in detail as follows.

The normal operation display step S300 may include a step S310 of displaying a normal operation of the heating stop, when it is detected that the gas valve 7 is closed at step S130, and when it is detected that the flow rate of the fuel gas R in the manifold 8 is '0' at step S140.

The normal operation display step S300 may include a step S320 of displaying the abnormality of the gas valve 7 or the flow sensor 14, when it is detected that the gas valve 7 is closed at step S130, and when it is detected that the flow rate of the fuel gas R in the manifold 8 exceeds '0' at step S140.

The reason why the abnormality of the gas valve 7 'or' the flow sensor 14 is displayed at step S320 is explained. In a situation where the operation of the igniter 16 is stopped and no flame is generated at step S50, it can be understood that since it is difficult to accurately determine which of the gas valve 7 and the flow sensor 14 works properly, it may be conservatively displayed as an abnormality of the gas valve 7 'or' the flow sensor 14.

That is, when it is detected that the gas valve 7 is closed at step S130, in a situation where it is detected that the flow rate of the fuel gas R in the manifold 8 exceeds '0' at step S140 so that information is inconsistent with each other, among the gas valve 7 and the flow sensor 14, both (i) a case where only the flow sensor 14 is operating normally (i.e., the gas valve 7 is actually open), and (ii) a case where only the gas valve 7 operates normally (i.e., the actual flow rate of the fuel gas R in the manifold 8 is '0') are available. However, in both cases, there is no difference in that a flame is not detected by the flame detection unit 17. Therefore, it may be preferable that the step S320 is "displayed as abnormality of the gas valve 7 'or' the flow sensor 14".

The normal operation display step S300 may include a step S330 of displaying an abnormality of the gas valve 7 if the gas valve 7 is detected to be opened at step S130.

After steps S320 and S330, an abnormal stop step S500 may be performed. The abnormal stop step S500 is a step of stopping the heating operation while operating the inducer 4, when at least one of the gas valve 7 and the flow sensor 14 is abnormal.

That is, at step S500, at least one of the gas valve 7 and the flow sensor 14 is abnormal, so that the fuel gas R is supplied into the heat exchanger 2 regardless of the gas valve close command signal at step S60. Therefore, the step S500 may be a step of operating the inducer 4 to discharge the gas remaining in the heat exchanger 2 to the outside through the exhaust pipe 5. This makes it possible to eliminate safety hazards such as gas explosion due to abnormal operation of the gas valve 7 and the flow sensor 14.

In this case, the step S500 may be a step of maintaining the operation of the inducer 4 when the inducer 4 is in operation during the heating operation before the stop signal R2 is received, and starting the operation of the inducer 4 when the inducer 4 is not in operation during the heating stop before the stop signal R2 is received.

In addition, the operation stop of the igniter 16 performed at step S50 can be released only after the check of the gas valve 7 and the flow sensor 14 is completed. That is, when at least one of the gas valve 7 and the flow sensor 14 is abnormal, before the above check is accomplished, the igniter 16 may not be operated even if the heating signal R1 is received. This is to prevent the gas furnace 1 from being operated again before the safety of the gas furnace 1 is secured.

In the embodiment of the present disclosure, step S500 is performed after step S320 and step S330 respectively, but may be performed simultaneously or in reverse order.

According to the present disclosure, there are one or more of the following effects.

First, the risk of gas explosion can be minimized by detecting the malfunction of the gas valve through the flow sensor installed in the manifold.

Second, by detecting the flow rate of the fuel gas in the manifold through the flow sensor, it is possible to continuously monitor whether the degree of opening of the gas valve corresponds to a control signal.

Although the exemplary embodiments of the present disclosure have been disclosed for illustrative purposes, those skilled in the art will appreciate that various modifications, additions and substitutions are possible, without departing from the scope and spirit of the invention as disclosed in the accompanying claims. Accordingly, the scope of the present disclosure is not construed as being limited to the described embodiments but is defined by the appended claims as well as equivalents thereto.

What is claimed is:

1. A method of controlling a gas furnace comprising a gas valve that supplies a fuel gas to a manifold; a burner through which the fuel gas discharged from the manifold passes; an igniter that ignites a mixture of fuel gas passed through the burner and air; and an inducer that generates a flow in which a combustion gas generated by the burning of the mixture is discharged to an exhaust pipe via a heat exchanger, wherein the gas furnace performs a heating operation according to a heating signal or a heating stop according to a stop signal, the method comprising:

receiving any one of the heating signal or the stop signal;

transmitting a signal to operate the inducer when the heating signal is received;

operating the igniter;

transmitting a signal to open the gas valve;

detecting whether the gas valve is opened or closed;

detecting a flow rate of the fuel gas in the manifold;

displaying a normal operation of the heating operation, based on information detected in the detecting of whether the gas valve is opened or closed and the detecting of the flow rate of the fuel gas in the manifold; and stopping the heating operation by stopping the operation of the igniter, closing the gas valve, and maintaining the operation of the inducer, when at least one of the gas valve or the flow sensor is abnormal, wherein the transmitting of the signal to open the gas valve comprises transmitting a signal so that the gas valve is opened in correspondence with a certain required thermal power of the gas furnace, and the method further comprises monitoring whether the flow rate of the fuel gas in the manifold corresponds to the signal transmitted, and wherein the operation stop of the igniter is able to be released only when a check of the gas valve and the flow sensor is completed, if the at least one of the gas valve or the flow sensor is abnormal.

2. The method of claim 1, wherein the detecting of the flow rate of the fuel gas in the manifold comprises detecting the flow rate of the fuel gas in the manifold using a flow sensor provided in the manifold.

3. The method of claim 2, wherein the displaying of the normal operation of the heating operation comprises displaying the normal operation of the heating operation, when it is detected that the gas valve is opened, and when it is detected that the flow rate of the fuel gas in the manifold exceeds '0'.

4. The method of claim 3, wherein the displaying of the normal operation of the heating operation further comprises displaying an abnormal operation of the flow sensor, when it is detected that the gas valve is opened, and when it is detected that the flow rate of the fuel gas in the manifold is '0'.

5. The method of claim 2, wherein the displaying of the normal operation of the heating operation further comprises displaying an abnormal operation of the gas valve, when it is detected that the gas valve is closed, and when it is detected that the flow rate of the fuel gas in the manifold exceeds '0'.

6. The method of claim 5, wherein the displaying of the normal operation of the heating operation further comprises displaying an abnormal operation of the gas valve and the flow sensor, when it is detected that the gas valve is closed, and when it is detected that the flow rate of the fuel gas in the manifold is '0'.

7. A method of controlling a gas furnace comprising a gas valve that supplies a fuel gas to a manifold; a burner through which the fuel gas discharged from the manifold passes; an igniter that ignites a mixture of fuel gas passed through the burner and air; and an inducer that generates a flow in which a combustion gas generated by the burning of the mixture is discharged to an exhaust pipe via a heat exchanger, wherein the gas furnace performs a heating operation according to a heating signal or a heating stop according to a stop signal, the method comprising the steps of:

receiving any one of the heating signal or the stop signal;

transmitting a signal to operate the inducer when the heating signal is received;

operating the igniter;

transmitting a signal to open the gas valve;

detecting whether the gas valve is opened or closed;

detecting a flow rate of the fuel gas in the manifold;

displaying a normal operation of the heating operation, based on information detected in the detecting of whether the gas valve is opened or closed and the detecting of the flow rate of the fuel gas in the manifold, and after the receiving of any one of the heating signal or the stop signal, the method further comprises:

stopping the operation of the igniter, when the stop signal is received;

transmitting a signal to close the gas valve;

detecting whether the gas valve is opened or closed;

detecting the flow rate of the fuel gas in the manifold; and displaying a normal operation of the heating stop, based on information detected in the detecting of whether the gas valve is opened or closed and the detecting of the flow rate of the fuel gas in the manifold.

8. The method of claim 7, wherein the detecting of the flow rate of the fuel gas in the manifold comprises detecting the flow rate of the fuel gas in the manifold using a flow sensor provided in the manifold.

9. The method of claim 8, wherein the detecting of whether the gas valve is opened or closed comprises detecting that the gas valve is opened when an open state of the gas valve is continued for a certain time.

10. The method of claim 9, wherein the displaying of the normal operation of the heating stop comprises displaying the normal operation of the heating stop, when it is detected that the gas valve is closed, and when it is detected that the flow rate of the fuel gas in the manifold is '0'.

11. The method of claim 10, wherein the displaying of the normal operation of the heating stop further comprises displaying an abnormal operation of the gas valve or the flow sensor, when it is detected that the gas valve is closed, and when it is detected that the flow rate of the fuel gas in the manifold exceeds '0'.

12. The method of claim 9, wherein the displaying of the normal operation of the heating stop further comprises displaying an abnormal operation of the gas valve, when the gas valve is detected to be opened.

13. The method of claim 11, further comprising stopping the heating operation while operating the inducer, when at least one of the gas valve or the flow sensor is abnormal.

14. The method of claim 13, wherein the operation stop of the igniter is able to be released only when a check of the gas valve and the flow sensor is completed, if at least one of the gas valve and the flow sensor is abnormal.

15. A method of controlling a gas furnace comprising a gas valve that supplies a fuel gas to a manifold; a burner through which the fuel gas discharged from the manifold passes; an igniter that ignites a mixture of fuel gas passed through the burner and air; and an inducer that generates a flow in which a combustion gas generated by the burning of the mixture is discharged to an exhaust pipe via a heat exchanger, wherein the gas furnace performs a heating operation according to a heating signal or a heating stop according to a stop signal, the method comprising:

receiving any one of the heating signal or the stop signal;

transmitting a signal to operate the inducer when the heating signal is received;

operating the igniter;

transmitting a signal to open the gas valve;

detecting whether the gas valve is opened or closed;

detecting a flow rate of the fuel gas in the manifold; and displaying a normal operation of the heating operation, based on information detected in the detecting of whether the gas valve is opened or closed and the detecting of the flow rate of the fuel gas in the manifold, wherein the detecting of the flow rate of the fuel gas in the manifold comprises detecting the flow rate of the fuel gas in the manifold using a flow sensor provided in the manifold, wherein the displaying of the normal operation of the heating operation comprises displaying the normal operation of the heating operation, when it is detected that the gas valve is opened, and when it is detected that the flow rate of the fuel gas in the manifold exceeds '0', wherein the displaying of the normal operation of the heating operation further comprises displaying an abnormal operation of the flow sensor, when it is detected that the gas valve is opened, and when it is detected that the flow rate of the fuel gas in the manifold is '0', wherein the method further comprises stopping the heating operation by stopping the operation of the igniter, closing the gas valve, and maintaining the operation of the inducer, when at least one of the gas valve or the flow sensor is abnormal, and wherein the operation stop of the igniter is able to be released only when a check of the gas valve and the flow sensor is completed, if the at least one of the gas valve and the flow sensor is abnormal.

* * * * *